US010864734B2

(12) United States Patent
Seki

(10) Patent No.: US 10,864,734 B2
(45) Date of Patent: Dec. 15, 2020

(54) INKJET HEAD AND INKJET PRINTER

(71) Applicant: TOSHIBA TEC KABUSHIKI KAISHA, Tokyo (JP)

(72) Inventor: Masashi Seki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/407,230

(22) Filed: May 9, 2019

(65) Prior Publication Data

US 2019/0358954 A1 Nov. 28, 2019

(30) Foreign Application Priority Data

May 23, 2018 (JP) ..... 2018-098463

(51) Int. Cl.

| | |
|---|---|
| ***B41J 2/045*** | (2006.01) |
| ***B41J 2/16*** | (2006.01) |
| ***B41J 2/165*** | (2006.01) |
| ***B41J 2/14*** | (2006.01) |
| ***B41J 2/055*** | (2006.01) |

(52) U.S. Cl.

CPC ..... *B41J 2/1606* (2013.01); *B41J 2/045* (2013.01); *B41J 2/04581* (2013.01); *B41J 2/055* (2013.01); *B41J 2/14233* (2013.01); *B41J 2/165* (2013.01); *B41J 2002/16502* (2013.01)

(58) Field of Classification Search

CPC ..... B41J 2/045; B41J 2/04581; B41J 2/055; B41J 2/14233; B41J 2/1433; B41J 2/1606; B41J 2/162; B41J 2002/16502

See application file for complete search history.

(56) References Cited

U.S. PATENT DOCUMENTS

| | | | | |
|---|---|---|---|---|
| 2005/0068368 | A1* | 3/2005 | Ishizuka | B41J 2/1606 347/45 |
| 2007/0115323 | A1* | 5/2007 | Mori | B41J 2/1606 347/40 |
| 2010/0302326 | A1* | 12/2010 | Morohoshi | B41J 2/1433 347/86 |
| 2019/0016084 | A1* | 1/2019 | Hayashi | G02B 1/18 |

FOREIGN PATENT DOCUMENTS

| | | |
|---|---|---|
| JP | 2007-105942 | 4/2007 |

* cited by examiner

*Primary Examiner* — Anh T Vo

(74) *Attorney, Agent, or Firm* — Amin, Turocy & Watson, LLP

(57) ABSTRACT

According to one embodiment, an inkjet head achieving excellent landing accuracy and an inkjet printer including such an inkjet head are provided. An inkjet head according to one embodiment includes a nozzle plate provided with a nozzle that ejects an ink having a surface tension within a range of 20 to 30 mN/m to a recording medium. The nozzle plate includes a nozzle plate substrate and a fluid repellent film provided on a face opposed to the recording medium of the nozzle plate substrate, and the fluid repellent film contains a fluorine-based compound having a terminal perfluoroalkyl group with 7 or less carbon atoms, and has a static contact angle with pure water within a range of 100° to 120°.

20 Claims, 4 Drawing Sheets

INKJET HEAD AND INKJET PRINTER

CROSS-REFERENCE TO RELATED APPLICATION

This application is based upon and claims the benefit of priority from Japanese Patent Application No. 2018-098463, filed May 23, 2018, the entire contents of which are incorporated herein by reference.

FIELD

Embodiments described herein relate to an inkjet head and an inkjet printer.

BACKGROUND

For example, in an inkjet head that ejects an ink droplet from a nozzle provided in a nozzle plate by pressurizing an ink by a piezoelectric element, ink repellency is imparted to the surface of the nozzle plate so that the ink is not adhered thereto. In order to impart ink repellency to the surface of the nozzle plate, for example, a fluid repellent film made of a fluorine-based silane-coupling agent is formed on the surface of a nozzle plate substrate (JP-A-2007-105942).

DETAILED DESCRIPTION

Figure 1:
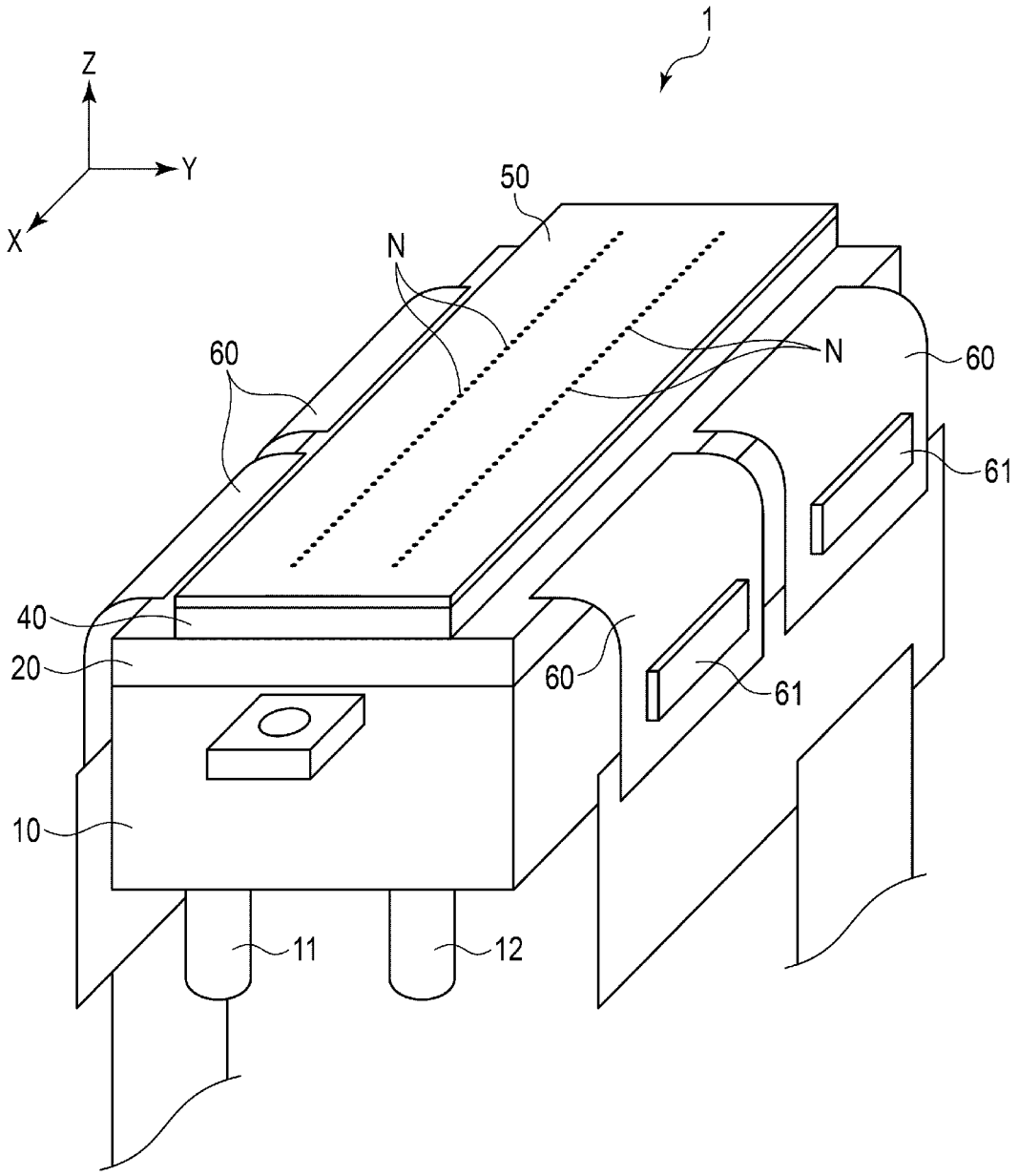
FIG. 1 is a perspective view showing an inkjet head according to an embodiment.

An object of embodiments herein is to provide an inkjet head achieving excellent landing accuracy and an inkjet printer including such an inkjet head.

According to a first aspect, an inkjet head including a nozzle plate provided with a nozzle that ejects an ink having a surface tension within a range of 20 to 30 mN/m to a recording medium, wherein the nozzle plate includes a nozzle plate substrate and a fluid repellent film provided on a face opposed to the recording medium of the nozzle plate substrate, and the fluid repellent film contains a fluorine-based compound having a terminal perfluoroalkyl group with 7 or less carbon atoms, and has a static contact angle with pure water within a range of 100° to 120° is provided.

According to a second aspect, an inkjet printer including the inkjet head according to the first aspect and a medium holding mechanism that holds a recording medium opposed to the inkjet head is provided.

Hereinafter, embodiments will be described with reference to the drawings. Components having the same or a similar function are denoted by the same reference numeral, and repetitive description is omitted.

Hereinafter, embodiments will be described with reference to the drawings.

FIG. 1 is a perspective view showing an on-demand type inkjet head 1 according to an embodiment to be used by being mounted on a head carriage of an inkjet printer. In the following description, an orthogonal coordinate system formed by X axis, Y axis, and Z axis is used. A direction indicated by an arrow in the drawing is defined as "plus direction" for the sake of convenience. The X-axis direction corresponds to a print width direction. The Y-axis direction corresponds to a direction in which a recording medium is conveyed. The Z-axis plus direction is a direction opposed to the recording medium.

When schematically describing with reference to FIG. 1, the inkjet head 1 includes an ink manifold 10, an actuator substrate 20, a frame 40, and a nozzle plate 50.

The actuator substrate 20 has a rectangular shape with the X-axis direction as a longitudinal direction. Examples of a material of the actuator substrate 20 include alumina ($Al_2O_3$), silicon nitride ($Si_3N_4$), silicon carbide (SiC), aluminum nitride (AlN), and lead zirconate titanate (PZT: $Pb(Zr,Ti)O_3$).

The actuator substrate 20 is overlapped on the ink manifold 10 so as to close an opening end of the ink manifold 10. The ink manifold 10 is connected to an ink cartridge through an ink supply tube 11 and an ink return tube 12.

On the actuator substrate 20, the frame 40 is attached. On the frame 40, the nozzle plate 50 is attached. The nozzle plate 50 is provided with a plurality of nozzles N along the X-axis direction at predetermined intervals so as to form two rows along the Y axis.

Figure 2:
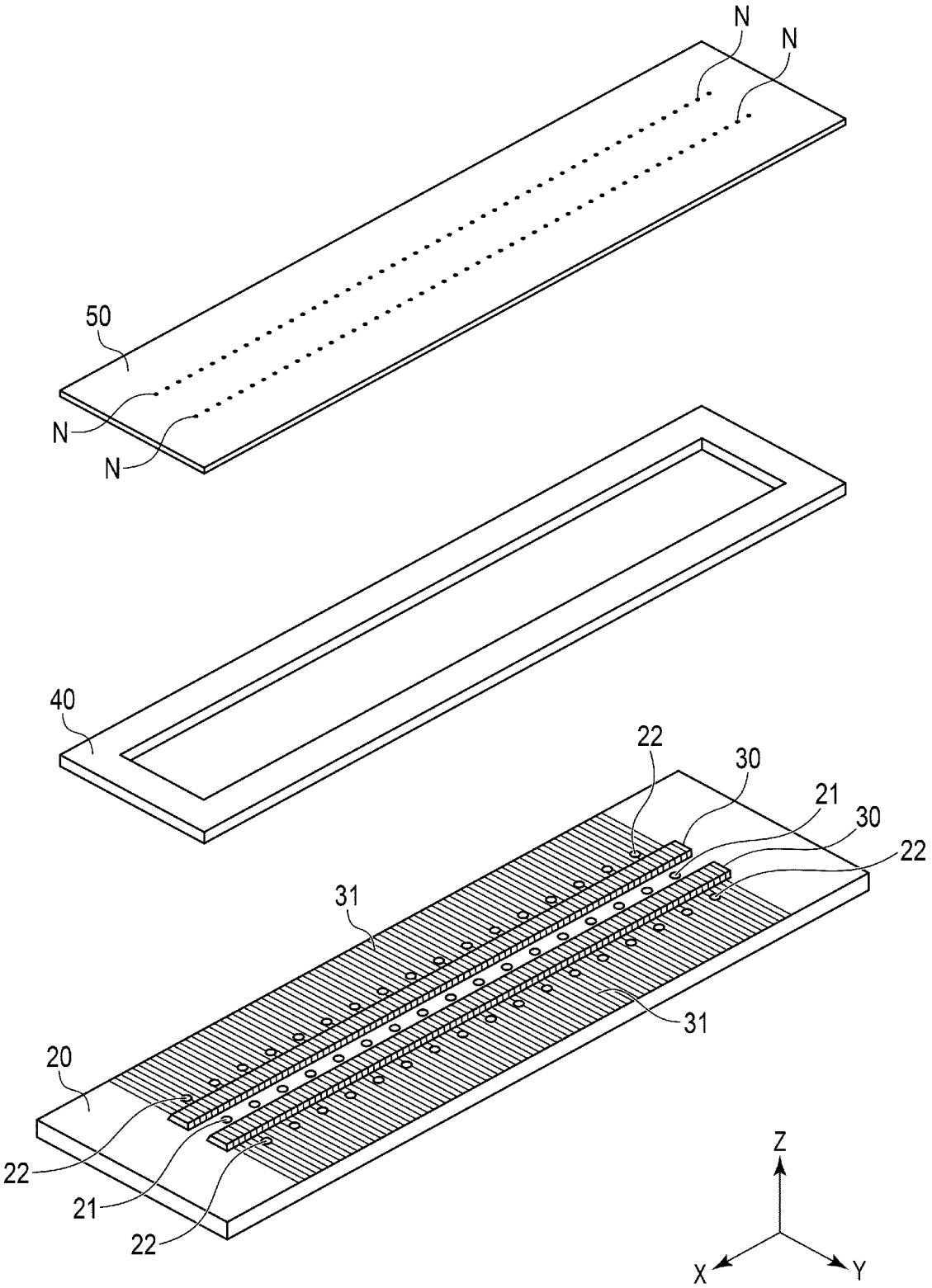
FIG. 2 is an exploded perspective view showing an actuator substrate, a frame, and a nozzle plate constituting an inkjet head according to an embodiment.

FIG. 2 is an exploded perspective view of the actuator substrate 20, the frame 40, and the nozzle plate 50 constituting the inkjet head 1 according to the embodiment. This inkjet head 1 is of a so-called shear mode shared-wall side-shooter type.

The actuator substrate 20 is provided with a plurality of ink supply ports 21 along the X-axis direction at predetermined intervals so as to forma row in a central portion in the Y-axis direction. Further, the actuator substrate 20 is provided with a plurality of ink discharge ports 22 along the X-axis direction at predetermined intervals so as to form rows in the Y-axis plus direction and the Y-axis minus direction with respect to the row of the ink supply ports 21, respectively.

Between the row of the ink supply ports 21 in the center and one of the rows of the ink discharge ports 22, a plurality of actuators 30 are provided. These actuators 30 form a row extending in the X-axis direction. Further, also between the row of the ink supply ports 21 in the center and the other row of the ink discharge ports 22, a plurality of actuators 30 are provided. Also these actuators 30 form a row extending in the X-axis direction.

Each of the rows composed of the plurality of actuators 30 is constituted by a first piezoelectric body and a second piezoelectric body stacked on the actuator substrate 20. Examples of a material of the first and second piezoelectric bodies include lead zirconate titanate (PZT), lithium niobate ($LiNbO_3$), and lithium tantalate ($LiTaO_3$). The first and second piezoelectric bodies are polarized mutually reversely along the thickness direction.

A stacked body composed of the first and second piezoelectric bodies is provided with a plurality of grooves each extending in the Y-axis direction and arranged in the X-axis direction. These grooves open on the second piezoelectric body side and have a larger depth than the thickness of the second piezoelectric body. Hereinafter, in this stacked body, a portion sandwiched between the adjacent grooves is referred to as "channel wall". These channel walls each extend in the Y-axis direction and are arranged in the X-axis direction. Incidentally, the groove between the adjacent two channel walls is an ink channel through which an ink flows.

On a side wall and a bottom of the ink channel, electrodes are formed. These electrodes are connected to a wiring pattern 31 extending along the Y-axis direction.

On a surface of the actuator substrate 20 including the electrodes and the wiring pattern 31 excluding a connection portion to the below-mentioned flexible printed circuit board, a protective film (not shown) is formed. The protective film includes, for example, a plurality of layers of inorganic insulating films and organic insulating films.

The frame 40 has an opening portion. This opening portion is smaller than the actuator substrate 20 and larger than a region where the ink supply ports 21, the actuators 30, and the ink discharge ports 22 are provided in the actuator substrate 20. The frame 40 is composed of, for example, a ceramic. The frame 40 is joined to the actuator substrate 20 with, for example, an adhesive.

The nozzle plate 50 includes a nozzle plate substrate and a fluid repellent film provided on a face opposed to the medium (a face on which the ink is ejected from the nozzle N). The nozzle plate substrate is composed of, for example, a resin film such as a polyimide film. The fluid repellent film will be described in detail later.

The nozzle plate 50 is larger than the opening portion of the frame 40. The nozzle plate 50 is joined to the frame 40 with, for example, an adhesive.

The nozzle plate 50 is provided with a plurality of nozzles N. These nozzles N form two rows corresponding to the ink channels. The diameter of the nozzle N becomes larger from the face opposed to the recording medium toward the ink channel. The dimension of the nozzle N is set to a predetermined value according to the ejection amount of the ink. The nozzles N can be formed by, for example, performing laser processing using an excimer laser.

The actuator substrate 20, the frame 40, and the nozzle plate 50 are integrated and form a hollow structure as shown in FIG. 1. A region surrounded by the actuator substrate 20, the frame 40, and the nozzle plate 50 is an ink flow chamber. The ink circulates such that the ink is supplied to the ink flow chamber from the ink manifold 10 through the ink supply port 21 and passes through the ink channel, and the excess ink returns from the ink discharge port 22 to the ink manifold 10. A portion of the ink is ejected from the nozzle N and used for printing while flowing through the ink channel.

To the wiring pattern 31, a flexible printed circuit board 60 is connected at a position on the actuator substrate 20 and outside the frame 40. On the flexible printed circuit board 60, a driving circuit 61 for driving the actuator 30 is mounted.

Hereinafter, an operation of the actuator 30 will be described. Here, the operation will be described by focusing on the ink channel in the center among the adjacent three ink channels. The electrodes corresponding to the adjacent three ink channels are referred to as A, B, and C. When an electric field is not applied in a direction orthogonal to the channel walls, the channel walls are in an upright state.

For example, to the electrode B in the center, a voltage pulse with a higher potential than the potential of the electrodes A and C on both sides is applied, and an electric field is generated in the direction orthogonal to the channel walls. By doing this, the channel walls are driven by a shear mode, and a pair of channel walls sandwiching the ink channel in the center are deformed so as to expand the volume of the ink channel in the center.

Subsequently, to the electrodes A and C on both sides, a voltage pulse with a higher potential than the potential of the electrode B in the center is applied, and an electric field is generated in the direction orthogonal to the channel walls. By doing this, the channel walls are driven by a shear mode, and a pair of channel walls sandwiching the ink channel in the center are deformed so as to reduce the volume of the ink channel in the center. By this operation, a pressure is applied to the ink in the ink channel in the center so as to discharge the ink from the nozzle N corresponding to this ink channel and allow the ink to land on a recording medium.

For example, all the nozzles are divided into three groups, and the above-mentioned driving operation is controlled in a time sharing manner and performed three cycles, and printing on the recording medium is performed.

Figure 3:
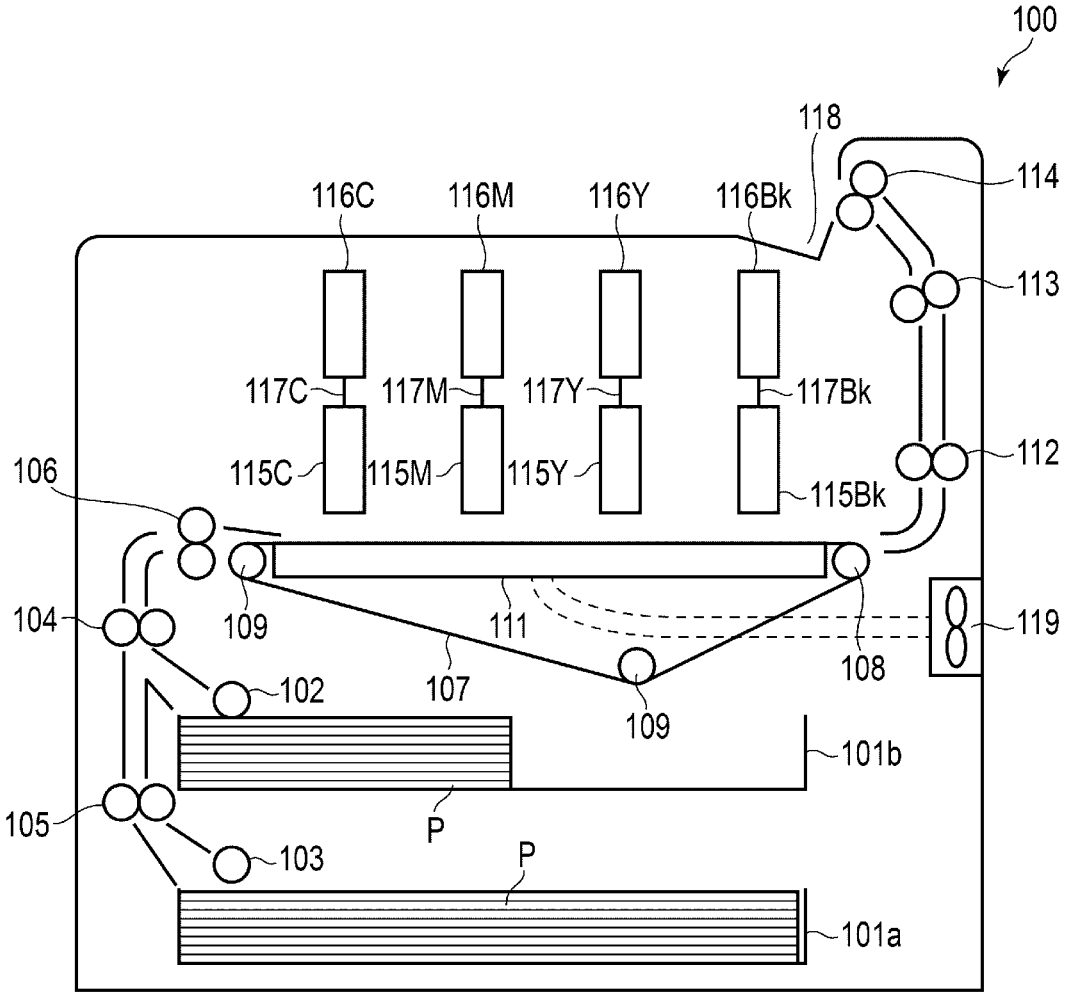
FIG. 3 is a schematic view showing an inkjet printer according to an embodiment.

FIG. 3 shows a schematic view of an inkjet printer 100. The inkjet printer 100 shown in FIG. 3 includes a housing provided with a paper discharge tray 118. In the housing, cassettes 101*a* and 101*b*, paper feed rollers 102 and 103, conveyance roller pairs 104 and 105, a resist roller pair 106, a conveyance belt 107, a fan 119, a negative pressure chamber 111, conveyance roller pairs 112, 113, and 114, inkjet heads 115C, 115M, 115Y, and 115Bk, ink cartridges 116C, 116M, 116Y, and 116Bk, and tubes 117C, 117M, 117Y, and 117Bk are placed.

The cassettes 101*a* and 101*b* house recording media P with different sizes. The paper feed roller 102 or 103 takes out a recording medium. P corresponding to the selected size of the recording medium from the cassette 101*a* or 101*b* and conveys the recording medium P to the conveyance roller pairs 104 and 105 and the resist roller pair 106.

To the conveyance belt 107, tension is applied by a driving roller 108 and two driven rollers 109. In the surface of the conveyance belt 107, holes are provided at predetermined intervals. Inside the conveyance belt 107, the negative pressure chamber 111 connected to the fan 119 is placed for adsorbing the recording medium P on the conveyance belt 107. Downstream in the conveyance direction of the conveyance belt 107, the conveyance roller pairs 112, 113, and 114 are placed. Further, in a conveyance path from the conveyance belt 107 to the paper discharge tray 118, a heater that heats a printed layer formed on the recording medium P can be placed.

Above the conveyance belt 107, four inkjet heads that eject the ink to the recording medium P according to image data are disposed. Specifically, the inkjet head 115C that ejects a cyan (C) ink, the inkjet head 115M that ejects a magenta (M) ink, the inkjet head 115Y that ejects a yellow (Y) ink, and the inkjet head 115Bk that ejects a black (Bk) ink are disposed in this order from the upstream side. Each of the inkjet heads 115C, 115M, 115Y, and 115Bk is the inkjet head 1 described with reference to FIGS. 1 and 2.

Above the inkjet heads 115C, 115M, 115Y, and 115Bk, the cyan (C) ink cartridge 116C, the magenta (M) ink cartridge 116M, the yellow (Y) ink cartridge 116Y, and the black (Bk) ink cartridge 116Bk each housing the ink corresponding thereto are placed. These cartridges 116C, 116M, 116Y, and 116Bk are connected to the inkjet heads 115C, 115M, 115Y, and 115Bk, respectively, through the tubes 117C, 117M, 117Y, and 117Bk, respectively.

In this embodiment, the ink having a surface tension within a range of 20 to 30 mN/m is used. When the surface tension of the ink is too large, the landing accuracy may be deteriorated due to the following reason.

That is, when the ink having a too large surface tension is allowed to land toward a paper face, there is a fear that the ink is likely to spread on the paper face to cause bleeding. Therefore, the landing accuracy such as accuracy of the shape or position of the ink after landing on the paper face may be deteriorated.

Further, if the surface tension of the ink is too small, the ink oozes out onto the surface of the nozzle plate from the nozzle when the ink is ejected, and the ejection volume of the ink is increased, and therefore, tailing in which a portion of the ink extends rearward in the ejection direction is likely to occur. Therefore, the landing position accuracy may be deteriorated due to disturbance of the flying direction or generation of mist.

The inkjet printer 100 includes the inkjet head 1 and a medium holding mechanism that holds the recording medium P opposed to the inkjet head. The medium holding mechanism also has a function as a recording paper moving mechanism that moves the recording medium P. The medium holding mechanism includes the conveyance belt 107, the driving roller 108, the driven rollers 109, the negative pressure chamber 111, and the fan 119.

Hereinafter, an image forming operation of this inkjet printer 100 will be described.

First, an image processing unit (not shown) starts image processing for recording and generates an image signal corresponding to the image data and also generates a control signal for controlling operations of various rollers, the negative pressure chamber 111, and the like.

The paper feed roller 102 or 103 takes out the recording medium P with a selected size one by one from the cassette 101*a* or 101*b* under the control of the image processing unit, and conveys the recording medium P to the conveyance roller pairs 104 and 105 and the resist roller pair 106. The resist roller pair 106 corrects a skew of the recording medium P and conveys the recording medium P at a predetermined timing.

The negative pressure chamber 111 sucks air through the holes of the conveyance belt 107. Therefore, the recording medium P in a state of being adsorbed on the conveyance belt 107 is sequentially conveyed to the positions below the inkjet heads 115C, 115M, 115Y, and 115Bk with the movement of the conveyance belt 107.

The inkjet heads 115C, 115M, 115Y, and 115Bk eject the inks in synchronization with the timing when the recording medium P is conveyed under the control of the image processing unit. In this manner, a color image is formed at a desired position on the recording medium P.

Thereafter, the conveyance roller pairs 112, 113, and 114 discharge the recording medium P on which the image is formed to the paper discharge tray 118. When a heater is placed in the conveyance path from the conveyance belt 107 to the paper discharge tray 118, the printed layer formed on the recording medium P may be heated by the heater. When heating is performed by the heater, particularly, if the recording medium P is impermeable, the adhesiveness of the printed layer to the recording medium P can be enhanced.

In the above-mentioned inkjet head 1, fluid repellency is imparted to the face opposed to the medium of the nozzle plate substrate. In order to impart fluid repellency, a fluid repellent film containing a fluorine-based compound is provided on the face opposed to the medium of the nozzle plate substrate.

The fluid repellent film contains a fluorine-based compound having a terminal perfluoroalkyl group with 7 or less carbon atoms. According to one example, any of the terminal perfluoroalkyl groups contained in the fluid repellent film has 5 or less carbon atoms. According to another example, any of the terminal perfluoroalkyl groups contained in the fluid repellent film has 3 or 4 carbon atoms. Further, according to still another example, the fluid repellent film does not contain a terminal perfluoroalkyl group having 8 or more carbon atoms. According to still yet another example, the fluid repellent film does not contain a terminal perfluoroalkyl group having 5 or more carbon atoms.

Further, the fluid repellent film has a static contact angle with pure water within a range of 100° to 120°. Here, the static contact angle is a static contact angle with pure water measured according to the sessile drop method in "Testing method of wettability of glass substrate" JIS R 3257:1999. However, here, the measurement is performed using the above-mentioned nozzle plate in place of a glass substrate. The fluid repellent film having a static contact angle within the above-mentioned range is advantageous in that the fluid repellent film repels the ink having a surface tension within a range of 20 to 30 mN/m.

By the way, the fluid repellency of the fluorine-based compound such as a fluorine-based silane-coupling agent is more favorable as the perfluoroalkyl group of the compound is longer. However, the toxicity of the fluorine-based compound is increased as the number of carbon atoms of the perfluoroalkyl group is larger. Therefore, use of the fluorine-based compound having a perfluoroalkyl group with 8 or more carbon atoms is prohibited. Further, even if the compound is a fluorine-based compound having a perfluoroalkyl group with 7 or less carbon atoms, use of the compound having a perfluoroalkyl group with a large carbon number begins to be regulated.

From the viewpoint of environment or safety, the number of carbon atoms of the perfluoroalkyl group of the fluorine-based compound is desirably smaller. However, the present inventor found that when the fluid repellent film is formed using the fluorine-based compound in which the number of carbon atoms of the perfluoroalkyl group is small, for example, 4 or less, favorable landing accuracy is hardly obtained in the inkjet printer as compared with the case where the fluid repellent film is formed using the fluorine-based compound in which the number of carbon atoms of the perfluoroalkyl group is large, for example, 8 or more, such as perfluorooctanoic acid (PFOA).

The inkjet head 1 provided with the above-mentioned fluid repellent film can eject the ink having a surface tension within a range of 20 to 30 mN/m with excellent landing accuracy. Further, even when the ink having a surface tension within a range of 20 to 26 mN/m is used, the inkjet head 1 provided with the above-mentioned fluid repellent film can eject the ink with excellent landing accuracy.

Incidentally, when the static contact angle of the fluid repellent film with pure water is too small, the difference in surface tension between the ink and the fluid repellent film is small, and therefore, the fluid repellent film hardly repels the above-mentioned ink. Further, when the static contact angle of the fluid repellent film with pure water is too large, the adhesion energy of the fluid repellent film with respect to the above-mentioned ink is large, and therefore, the fluid repellent film hardly repels the above-mentioned ink.

Hereinafter, the fluorine-based compound to be used in the embodiment will be further described.

According to one example, the above-mentioned fluorine-based compound has a binding moiety binding to the nozzle plate substrate and the above-mentioned terminal perfluoroalkyl group.

For example, this fluorine-based compound is a linear molecule having a binding moiety at one terminal and a perfluoroalkyl group at the other terminal. This fluorine-based compound does not contain a perfluoroalkyl group having 8 or more carbon atoms.

The binding moiety is, for example, a moiety binding to the nozzle plate substrate by a reaction with a functional group present on the surface of the nozzle plate substrate. The binding moiety contains, for example, a reactive functional group. In that case, by reacting the reactive functional group with a functional group present on the surface of the nozzle plate substrate, the binding moiety binds to the nozzle plate substrate. The reactive functional group is, for example, an epoxy group, an amino group, a methacrylic group, or an unsaturated hydrocarbon group such as a vinyl group, or a mercapto group. The functional group present on the surface of the nozzle plate substrate is, for example, a hydroxyl group, an ester bond, an amino group, or a thiol group. Alternatively, the binding moiety is an alkoxysilane group. In that case, by reacting a silanol group generated by hydrolysis of the alkoxysilane group with the functional group such as a hydroxyl group present on the surface of the nozzle plate substrate, the binding moiety binds to the nozzle plate substrate.

In the fluorine-based compounds adjacent to each other on the nozzle plate substrate, preferably, the binding moieties mutually bind to each other. According to one example, the binding moiety further contains one or more silicon atoms between the reactive functional group and the terminal perfluoroalkyl group, and in the fluorine-based compounds adjacent to each other on the nozzle plate substrate, the binding moieties mutually bind to each other through a siloxane bond (Si—O—Si).

The terminal perfluoroalkyl group is, for example, a linear terminal perfluoroalkyl group. According to one example, the terminal perfluoroalkyl group is upright along the perpendicular line direction of the nozzle plate substrate. Such an embodiment will be described in detail below.

The fluorine-based compound may further have a spacer linking group between the binding moiety binding to the nozzle plate substrate and the terminal perfluoroalkyl group. The presence of such a spacer linking group is advantageous in that the terminal perfluoroalkyl group has an upright structure along the perpendicular line direction of the nozzle plate substrate. The spacer linking group is, for example, a perfluoropolyether group.

Examples of such a fluorine-based compound include compounds represented by the following general formulae (1) and (2).

$$C_3F_7-(OCF_2CF_2CF_2)_p-O-(CF_2)_2-\left[CH_2CH(Si-(OCH_3)_3)\right]_n-H \quad (1)$$

In the general formula (1), p is a natural number of 1 to 50 and n is a natural number of 1 to 10.

$$C_3F_7-(OCF_2CF_2CF_2)_p-O-CF_2-Si-(OCH_3)_3 \quad (2)$$

In the general formula (2), p is a natural number of 1 to 50.

This structure is obtained, for example, as follows. Incidentally, here, as one example, a hydroxyl group is assumed to be present on the face opposed to the medium of the nozzle plate substrate, and the fluorine-based compound is assumed to contain an alkoxysilane group in the binding moiety.

The nozzle plate substrate is composed of, for example, a resin film such as a polyimide film as described above. In that case, the nozzle plate substrate has almost no hydroxyl groups necessary for binding to the fluorine-based compound on the surface thereof. Therefore, prior to the formation of the fluid repellent film, the nozzle plate substrate is preferably subjected to a pretreatment as described below.

For example, the face opposed to the medium of the nozzle plate substrate is subjected to a plasma treatment, thereby modifying the surface of the film. The plasma treatment is performed using, for example, oxygen gas, argon gas, or a mixed gas thereof. Preferably, the plasma treatment is performed using a mixed gas of oxygen gas and argon gas.

By performing the plasma treatment in an atmosphere containing oxygen, for example, the surface of the nozzle plate substrate can be modified with a hydroxyl group. Further, by performing the plasma treatment in an atmosphere containing argon, dust adhered to the surface of the nozzle plate substrate can be removed.

Subsequently, the above-mentioned fluorine-based compound is supplied to the surface of the nozzle plate substrate. This supply is performed by, for example, a vapor phase deposition method such as a vacuum deposition method. Alternatively, the fluorine-based compound is applied to the surface of the nozzle plate substrate.

Subsequently, an alkoxysilane group of the fluorine-based compound supplied to the surface of the nozzle plate substrate is hydrolyzed.

When the alkoxysilane group of the fluorine-based compound is hydrolyzed, a silanol group is generated. This silanol group causes dehydration condensation with the hydroxyl group present on the face opposed to the medium of the nozzle plate substrate. In this manner, the nozzle plate substrate and the fluorine-based compound bind to each other through a siloxy group (Si—O—) formed by a silicon atom contained in the binding moiety. Further, in the fluorine-based compounds adjacent to each other, silicon atoms in the binding moieties mutually bind to each other through a siloxane bond (Si—O—S).

Incidentally, to the silicon atom in the binding moiety, for example, the terminal perfluoroalkyl group binds through a perfluoropolyether group that is a spacer linking group. The spacer linking group has a function to make the terminal perfluoroalkyl group upright along the perpendicular line direction of the nozzle plate substrate as described above. Then, the terminal perfluoroalkyl group mainly exhibits ink repellency.

The terminal perfluoroalkyl group is represented by, for example, $CF_3$—$CF_2$—$CF_2$— when the number of carbon atoms is 3 (C3). The ink repellency of a $CF_3$ group is higher than that of a $CF_2$ group.

Further, when the above-mentioned fluid repellent film is analyzed by X-ray photoelectron spectroscopy (XPS), for example, a peak of the $CF_2$ group and a peak of the $CF_3$ group are detected. Then, the ratio of the peak area of the $CF_2$ group to the peak area of the $CF_3$ group is within a range of 1.5 to 4.0 according to one example.

Here, XPS will be described.

When a material is irradiated with a soft X-ray with an energy of about several kilo electron volts, an electron in an atomic orbital absorbs the light energy and is beaten out as a photoelectron. The binding energy Eb of the bound electron and the kinetic energy Ek of the photoelectron have the following relationship.

$$Eb = h\nu - Ek - \phi sp$$

Incidentally, in the above formula, hν is the energy of the incident X-ray, and ϕsp is the work function of the spectrometer.

As apparent from the above formula, if the energy of the X-ray is constant (that is, a single wavelength), the binding energy Eb of the electron can be determined based on the kinetic energy Ek of the photoelectron. The binding energy Eb of the electron is intrinsic to the element, and therefore, an elemental analysis can be performed. Further, a binding energy shift reflects the chemical bonding state or the valence state (oxidation number or the like) of the element, and therefore, the chemical bonding state of a constituent element can be examined.

Hereinafter, a case where the fluid repellent film provided on the face opposed to the medium of the nozzle plate substrate by the above-mentioned method was analyzed by the XPS method will be described.

As described above, when the fluid repellent film is analyzed by the XPS method, the ratio of the peak area of the $CF_2$ group to the peak area of the $CF_3$ group is within a range of 1.5 to 4.0 according to one example. Such a fluid repellent film is advantageous in that excellent ink repellency is exhibited.

Further, in the above-mentioned method, the nozzle plate substrate is subjected to a plasma treatment in advance, and thereafter, a reaction between the nozzle plate substrate and the binding moiety of the fluorine-based compound is caused. Therefore, not only when the fluorine-based compound having a terminal perfluoroalkyl group with 8 or more carbon atoms is used, but also even when the fluorine-based compound having a terminal perfluoroalkyl group with 7 or less, 5 or less, or 3 or 4 carbon atoms is used, the percentage that the terminal perfluoroalkyl group is upright along the perpendicular line direction of the nozzle plate substrate becomes high.

Specifically, when the fluid repellent film obtained in this manner is analyzed by the XPS method, a peak of the $CF_2$ group and a peak of the $CF_3$ group are detected and the ratio of the peak area of the $CF_2$ group to the peak area of the $CF_3$ group is within a range of 1.5 to 4.0. According to one example, this ratio is about 1.5 when the number of carbon atoms of the terminal perfluoroalkyl group is 3. Further, this ratio approaches 4.0 as the number of carbon atoms of the terminal perfluoroalkyl group approaches 5.

In this manner, in this fluid repellent film, many $CF_3$ groups are present in the surface region thereof. As described above, the ink repellency of the $CF_3$ group is higher than that of the $CF_2$ group. Therefore, such a fluid repellent film is advantageous in that excellent ink repellency is exhibited although the fluorine-based compound in which the number of carbon atoms of the terminal perfluoroalkyl group is small is used.

Further, in the above-mentioned structure, in the fluorine-based compounds, the binding moieties thereof bind to the surface of the nozzle plate substrate, preferably, the binding moieties mutually bind to each other. Therefore, even if cleaning with a wiping blade is repeated, the terminal perfluoroalkyl group only swings in the lateral direction, and never disappears from the surface of the fluid repellent film. Accordingly, the structure is advantageous in that deterioration of the ink repellency is suppressed.

EXAMPLES

Hereinafter, Examples will be described.

1. First Test Example 1-1. Formation of Liquid Repellent Film

An evaporation source containing a fluorine-based compound represented by the following chemical formula was prepared. Subsequently, a nozzle plate substrate was subjected to a plasma treatment in advance. As the nozzle plate substrate, a polyimide film was used. This nozzle plate substrate and the evaporation source were placed in a vacuum vapor deposition device, and by a vacuum vapor deposition method, the fluorine-based compound was deposited on a face opposed to a recording medium of the nozzle plate substrate. As described above, a fluid repellent film was formed on the face opposed to the recording medium of the nozzle plate substrate, whereby a nozzle plate was produced.

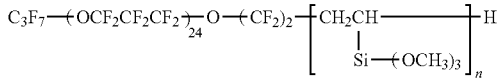

Here, a plurality of nozzle plates having mutually different static contact angles (described later) within a range of 80° to 140° were produced by changing the conditions for the plasma treatment.

1-2. Measurement of Static Contact Angle

With respect to the fluid repellent films included in the nozzle plates, a static contact angle with pure water was measured. Here, the measurement of the static contact angle was performed according to the sessile drop method in "Testing method of wettability of glass substrate" JIS R 3257:1999.

1-3. Evaluation of Fluid Repellency

With respect to the plurality of nozzle plates having different static contact angles obtained above, a time required for the nozzle plate to repel an ink was measured. Incidentally, as the ink, an ink prepared as follows was used.

That is, for example, an ink in which a pigment, an organic solvent, and a dispersant are contained, and the blending amounts thereof are adjusted so that the surface tension of the ink falls within a range of 20 to 30 mN/m was used.

The measurement of the time until occurrence of repelling of the ink was performed as follows.

First, as a sample, a nozzle plate with the above-mentioned fluid repellent film with a width of 15 mm was prepared. The nozzle plate was made upright and the vicinity of the upper end thereof was held, and substantially the entire nozzle plate was immersed in the ink. Subsequently, only a portion with a length of 45 mm of the nozzle plate was pulled up, and a time required for the ink to disappear from the pulled up portion was measured, and the result shown in FIG. 4 was obtained.

Figure 4:
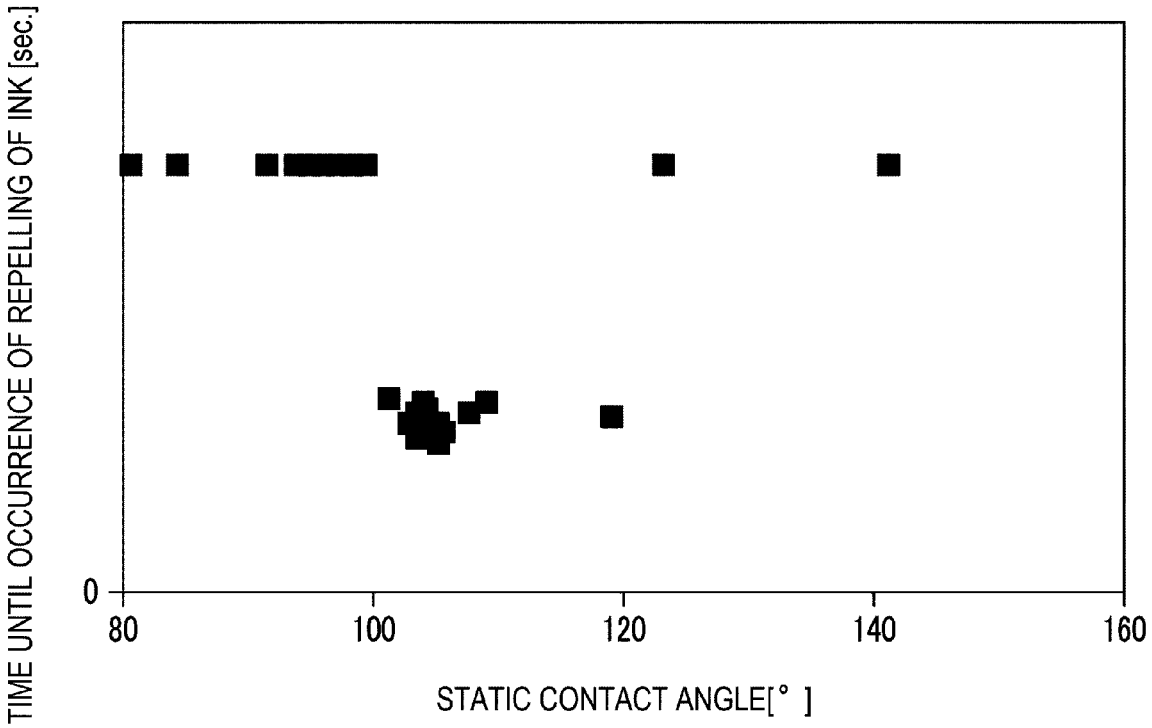
FIG. 4 is a graph showing a relationship between a static contact angle of a fluid repellent film and a time until the fluid repellent film repels an ink having a surface tension within a range of 20 to 30 mN/m.

FIG. 4 is a graph showing a relationship between the static contact angle of the fluid repellent film and the time until the fluid repellent film repels the ink having a surface tension within a range of 20 to 30 mN/m.

As shown in FIG. 4, the nozzle plate having a static contact angle within a range of 100° to 120° repelled the ink in a short time as compared with the nozzle plate having a static contact angle outside the range of 100° to 120°. On the other hand, the nozzle plate having a static contact angle less than 100° could not repel the ink. Further, also the nozzle plate having a static contact angle larger than 120° hardly repelled the ink. This is because when the static contact angle becomes large, the adhesion energy of the ink to the fluid repellent film becomes high.

As described above, the nozzle plate having a static contact angle within a range of 100° to 120° exhibited excellent fluid repellency to the ink having a surface tension within a range of 20 to 30 mN/m.

1-4. Evaluation of Landing Position Accuracy

The landing position accuracy when the inkjet head including the above-mentioned nozzle plate ejects an ink having a surface tension within a range of 20 to 30 mN/m was evaluated by visual observation.

As a result, when the nozzle plate having a static contact angle less than 100° was used, mist was generated when the ink was ejected, and collapse in shape and positional displacement of the ink after landing were observed. Also when the nozzle plate having a static contact angle larger than 120° was used, collapse in shape and positional displacement of the ink after landing were observed.

On the other hand, when the nozzle plate having a static contact angle within a range of 100° to 120° was used, collapse in shape or positional displacement of the ink after landing was not observed, and excellent landing accuracy was achieved.

Second Test Example 2-1. Production of Nozzle Plate 2-1-1. Nozzle Plate N1

A nozzle plate was produced in the same manner as in the first test example. Hereinafter, the obtained nozzle plate is referred to as "nozzle plate N1". The fluid repellent film of the nozzle plate N1 had a static contact angle with pure water of 105°.

2-1-2. Nozzle Plate N2

A nozzle plate was produced in the same manner as the nozzle plate N1 except that a fluorine-based compound having a cyclic structure was used as the material of the fluid repellent film. Hereinafter, the obtained nozzle plate is referred to as "nozzle plate N2". The fluid repellent film of the nozzle plate N2 had a static contact angle with pure water of 110°.

2-1-3. Nozzle Plate N3

A nozzle plate was produced in the same manner as the nozzle plate N1 except that a fluorine-based compound containing a terminal perfluoroalkyl group with 7 carbon atoms was used as the material of the fluid repellent film. Hereinafter, the obtained nozzle plate is referred to as "nozzle plate N3". The fluid repellent film of the nozzle plate N3 had a static contact angle with pure water of 110°.

2-2. Evaluation of Fluid Repellency

With respect to each of the nozzle plates N1 to N3, a time required for repelling an ink was measured and evaluation of fluid repellency was performed in the same manner as in the "1-3. Evaluation of Fluid Repellency". Incidentally, here, inks having a surface tension of 15 mN/m, 25 mN/m, 30 mN/m, or 40 mN/m were used.

Figure 5:
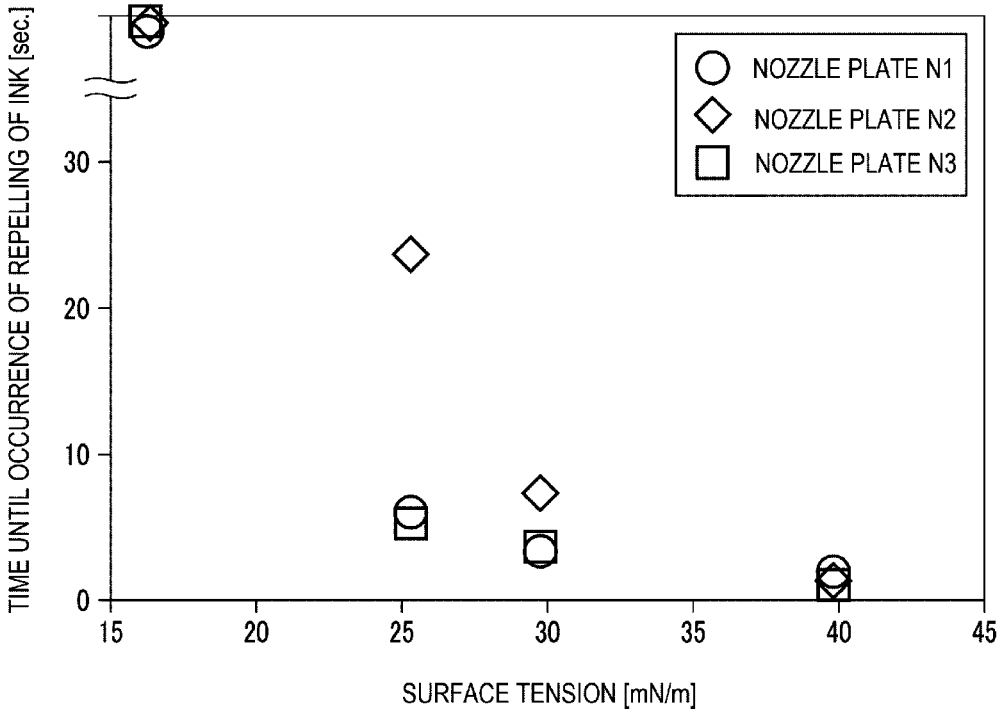
FIG. 5 is a graph showing a relationship between a magnitude of a surface tension of an ink and a time until a fluid repellent film repels the ink.

The results are shown in FIG. 5. FIG. 5 is a graph showing a relationship between the magnitude of the surface tension of the ink and the time until the fluid repellent film repels the ink.

As shown in FIG. 5, the nozzle plates N1 and N3 could repel the ink in a very short time as compared with the nozzle plate N2 when the surface tension of the ink was 25 mN/m. Further, also when the surface tension of the ink was 30 mN/m, the nozzle plates N1 and N3 could repel the ink in a short time as compared with the nozzle plate N2.

Further, the nozzle plate N1 could achieve fluid repellency comparable to the nozzle plate N3 although the number of carbon atoms is smaller than that of the nozzle plate N3.

With respect to any figure or numerical range for a given characteristic, a figure or a parameter from one range may be combined with another figure or a parameter from a different range for the same characteristic to generate a numerical range.

Other than in the operating examples, if any, or where otherwise indicated, all numbers, values and/or expressions referring to parameters, measurements, conditions, etc., used in the specification and claims are to be understood as modified in all instances by the term "about."

The invention is not limited to the embodiments described above and can be modified variously without departing from the gist of the invention when it is practiced. Also, the respective embodiments may be appropriately combined and carried out, and combined effects can be obtained in that case. Further, the embodiments described above include various inventions, and various inventions can be extracted by combinations selected from a plurality of disclosed constituent elements. For example, even if several constituent elements are deleted from all the constituent elements disclosed in the embodiments, a structure in which the constituent elements are deleted can be extracted as the invention when the problem can be solved and the effect can be obtained.

What is claimed is:

1. An inkjet head, comprising a nozzle plate provided with a nozzle that ejects an ink having a surface tension from 20 mN/m to 30 mN/m to a recording medium, wherein the nozzle plate includes a nozzle plate substrate and a fluid repellent film provided on a face opposed to the recording medium of the nozzle plate substrate, and the fluid repellent film comprises a fluorine-based compound having a terminal perfluoroalkyl group with 7 or less carbon atoms, and has a static contact angle with pure water from 100° to 120°.

2. The head according to claim 1, wherein the surface tension of the ink is from 20 mN/m to 26 mN/m.

3. The head according to claim 1, wherein the terminal perfluoroalkyl group of the fluorine-based compound has 5 or less carbon atoms.

4. The head according to claim 1, wherein the terminal perfluoroalkyl group of the fluorine-based compound has 3 or 4 carbon atoms.

5. The head according to claim 1, wherein the nozzle plate substrate comprises a resin.

6. The head according to claim 1, wherein of the fluorine-based compound comprises a binding moiety and the terminal perfluoroalkyl group.

7. The head according to claim 6, wherein the fluorine-based compound further comprises a spacer linking group between the binding moiety and the terminal perfluoroalkyl group.

8. An inkjet printer, comprising:

an inkjet head comprising a nozzle plate provided with a nozzle that ejects an ink having a surface tension from 20 mN/m to 30 mN/m to a recording medium, wherein the nozzle plate includes a nozzle plate substrate and a fluid repellent film provided on a face opposed to the recording medium of the nozzle plate substrate, and the fluid repellent film comprises a fluorine-based compound having a terminal perfluoroalkyl group with 7 or less carbon atoms, and has a static contact angle with pure water from 100° to 120°; and a medium holding mechanism that holds a recording medium opposed to the inkjet head.

9. The printer according to claim 8, wherein the surface tension of the ink is from 20 mN/m to 26 mN/m.

10. The printer according to claim 8, wherein the terminal perfluoroalkyl group of the fluorine-based compound has 5 or less carbon atoms.

11. The printer according to claim 8, wherein the terminal perfluoroalkyl group of the fluorine-based compound has 3 or 4 carbon atoms.

12. The printer according to claim 8, wherein the nozzle plate substrate comprises a resin.

13. The printer according to claim 8, wherein of the fluorine-based compound comprises a binding moiety and the terminal perfluoroalkyl group.

14. The printer according to claim 13, wherein the fluorine-based compound further comprises a spacer linking group between the binding moiety and the terminal perfluoroalkyl group.

15. An inkjet printing method, comprising:

ejecting ink through a nozzle plate to a recording medium, the ink having a surface tension from 20 mN/m to 30 mN/m;

the nozzle plate including a nozzle plate substrate and a fluid repellent film provided on a face opposed to the recording medium of the nozzle plate substrate, the fluid repellent film comprising a fluorine-based compound having a terminal perfluoroalkyl group with 7 or less carbon atoms, and having a static contact angle with pure water from 100° to 120°.

16. The method according to claim 15, wherein the surface tension of the ink is from 20 mN/m to 26 mN/m.

17. The method according to claim 15, wherein the terminal perfluoroalkyl group of the fluorine-based compound has 5 or less carbon atoms.

18. The method according to claim 15, wherein the terminal perfluoroalkyl group of the fluorine-based compound has 3 or 4 carbon atoms.

19. The method according to claim 15, wherein the nozzle plate substrate comprises a resin.

20. The method according to claim 15, wherein of the fluorine-based compound comprises a binding moiety and the terminal perfluoroalkyl group.

* * * * *